United States Patent [19]

Trimborn

[11] Patent Number: 4,755,107

[45] Date of Patent: Jul. 5, 1988

[54] LIQUID-RING PUMP HAVING ADDITIONAL OPENINGS IN CONTROL DISC FOR WARM AND COLD LIQUID

[75] Inventor: Peter Trimborn, Nuremberg, Fed. Rep. of Germany

[73] Assignee: Siemens Aktiengesellschaft, Munich, Fed. Rep. of Germany

[21] Appl. No.: 27,824

[22] Filed: Mar. 19, 1987

[30] Foreign Application Priority Data

May 14, 1986 [DE] Fed. Rep. of Germany ..... 3616298

[51] Int. Cl.[4] ..... F04C 19/00

[52] U.S. Cl. ..... 417/68

[58] Field of Search ..... 417/68, 69

[56] References Cited

U.S. PATENT DOCUMENTS

| | | | |
|---|---|---|---|
| 2,195,174 | 3/1940 | Jennings | 417/68 |
| 2,195,375 | 3/1940 | Adams | 417/68 X |
| 4,545,730 | 10/1985 | Lübke | 417/68 |

FOREIGN PATENT DOCUMENTS

| | | | |
|---|---|---|---|
| 51080 | 12/1935 | Denmark | 417/68 |
| 1027358 | 4/1958 | Fed. Rep. of Germany | 417/68 |
| 31686 | 2/1986 | Japan | 417/68 |
| 1509661 | 5/1978 | United Kingdom | 417/68 |
| 1121500 | 10/1984 | U.S.S.R. | 417/68 |

*Primary Examiner*—Carlton R. Croyle
*Assistant Examiner*—Paul F. Neils
*Attorney, Agent, or Firm*—Kenyon & Kenyon

[57] ABSTRACT

A liquid ring machine, in particular, a liquid ring pump comprises a control disk having an opening for a vane wheel shaft and first and second partial ring slots spatially separated from each other and located between an inner edge of a suction slot and the vane wheel shaft opening and an inner edge of a pressure slot and the vane wheel shaft opening of the control disk respectively. An opening to the first partial ring slot from an end bell of the machine is provided at a narrow end of the suction slot for exclusive feeding in of a cold portion of operating liquid. An opening to the second partial ring slot from the end bell is provided between the wide end of the suction slot and the beginning of the pressure slot for exclusive feeding in of a warm portion of operating liquid. The condensation of liquid especially in the vicinity of the suction slot is improved while undesirable evaporation of operating liquid is reduced.

7 Claims, 4 Drawing Sheets

LIQUID-RING PUMP HAVING ADDITIONAL OPENINGS IN CONTROL DISC FOR WARM AND COLD LIQUID

BACKGROUND OF THE INVENTION

The present invention relates to the field of so-called liquid-ring pumps having a vane wheel, arranged eccentrically within a housing, which revolves while engaged with a ring of rotating liquid.

Electric machines known in the art as liquid-ring pumps generally are employed as pumps for a gaseous medium. A housing for such a pump surrounds a ring of rotating liquid which is caused to rotate by an eccentrically mounted vane wheel turned by a revolving shaft. The shaft, in turn, is supported at each end in an end bell having inlet and outlet ports for the gaseous medium to be pumped as well as at least one inlet for operating liquid which replenishes any liquid lost, for example, through evaporation into the pumped medium. Because of the eccentric mounting of the vane wheel, operating liquid on one side of the vane wheel creates a suction zone in which zone the pumped gaseous medium is sucked into the pump by way of the inlet ports in the end bells. On the other side of the eccentrically mounted vane wheel, a pressure zone is created where the pumped gaseous medium is forced to exit the pump by way of the outlet ports in the end bells. Between the end bells and the vane wheel housing or comprising a part of the end bell itself is a control disc which partitions the end bell into separate chambers for operating liquid and pumped gaseous medium as well as provides control openings for the entry and exit of both operating liquid and gaseous medium. The control disc is typically sealed with the end bell on one side and seals the housing on the other side. At the same time, the control disc is designed to comprise separate pressure and suction slots for the pumped gaseous medium concentrically arranged outside a hub of the vane wheel. Also, an opening for operating liquid is typically arranged in the vicinity of the vane wheel hub so that the operating liquid further fulfills the function of a gap sealing liquid sealing the gap between the vane wheel hub and the control disc.

One such liquid-ring pump is known from German Auslegeschrift No. 1027358, in which a first part of operating liquid for the machine accordingly warmed up by the action of the rotating vane wheel is taken from the rotating liquid ring via an opening in a control disk behind the end of a pressure slot of the disc. The liquid is then fed via a radial transfer slot to a ring slot concentric with the shaft which is covered by a hub of the vane wheel and from which ring slot the warmed liquid part flows radially via the entire circumference of the ring slot as a gap-sealing liquid toward the rotating liquid ring. A second, colder partial quantity of the operating liquid replaces the liquid-ring losses and is fed from the outside at lower pressure via an opening not covered by the vane wheel hub between the end of the suction slot and the beginning of a pressure slot to the liquid ring. A liquid separator may be used following the outlet of the control disk to condense evaporated liquid lost from the liquid ring machine which is cooled and returned to the machine for recycling.

In other known liquid-ring pump designs (for example, one disclosed in U.S. Pat. No. 4,545,730), the colder partial quantity of operating liquid is fed-in from the outside, for example, from a source under pressure and mixed in an end bell of the pump with the partial warmer quantity accumulating in the sump of the end bell from the liquid ring. The colder partial quantity is returned mixed with the warmer quantity via a suitable passage in the control disk to the rotating liquid ring in the housing, said passage being located in the region between the end of the suction slot and the beginning of the pressure slot.

In these known cases, the amount of operating liquid fed to the rotating liquid ring, at least in the vicinity of the suction slot, is warmer than the cold portion of liquid entering the machine which makes the desirable condensation effect worse in this region in the case of high humidity or water-vapor suction. Undesirable evaporation of the liquid in the pump is increased if dry gas is transported through the machines.

Consequently, it is highly desirable to improve, in such liquid-ring pumps the condensation effect in the vicinity of the suction slot and to reduce the evaporation effect if dry gas is transported thereby increasing the overall suction capacity of the pump.

SUMMARY OF THE INVENTION

A successful solution of the problem is possible by providing a first and a second slot for the passage of operating liquid separated from each other and located generally between the suction slot and the vane wheel hub and the pressure slot and the hub, respectively, each covered by the vane wheel hub, each communicating exclusively with either warm or cold liquid through at least one opening to separate chambers of an end bell.

DETAILED DESCRIPTION

Figure 1:
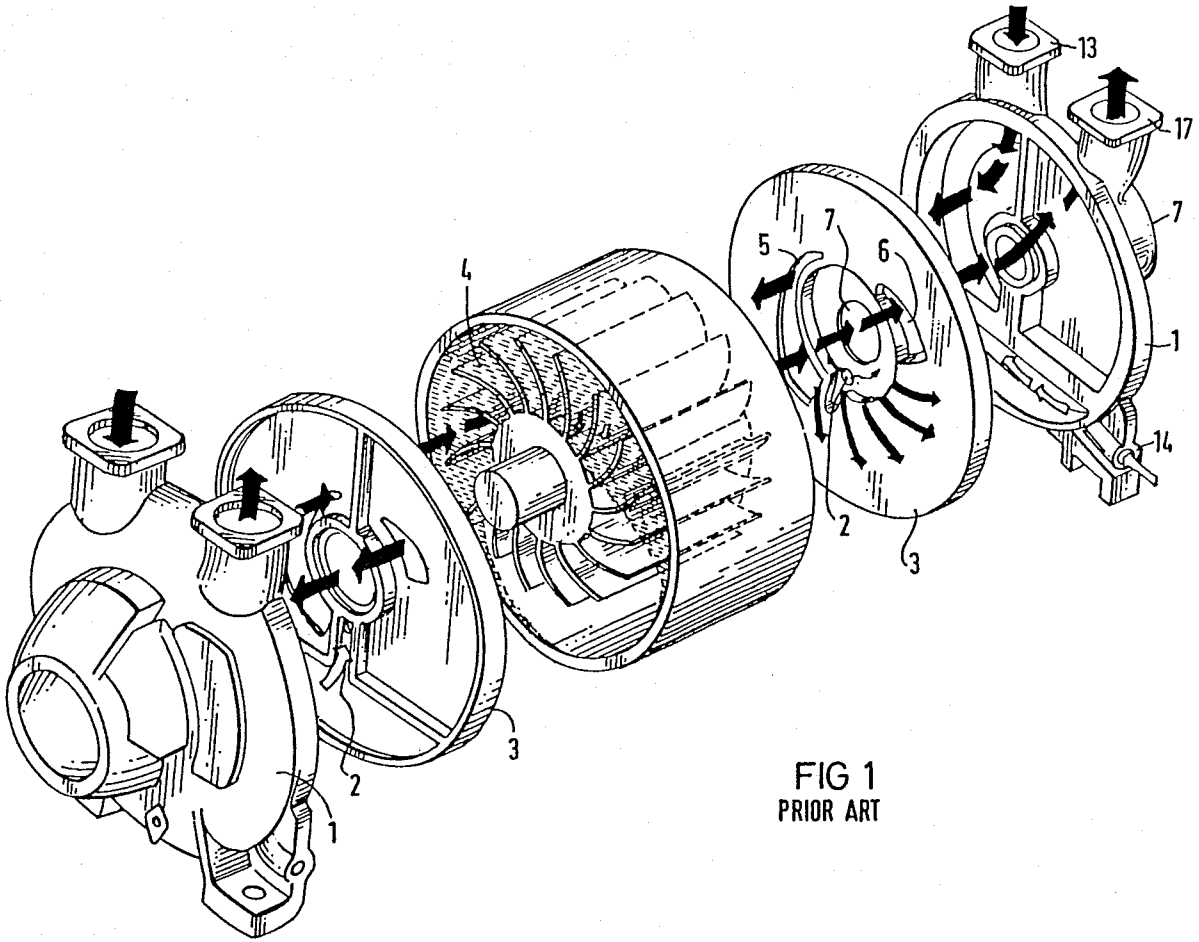
FIG 1 PRIOR ART
FIG. 1 is an exploded perspective view of a liquid-ring pump of the prior art.

In FIG. 1 a known double-flow ring pump is shown in an exploded perspective view, in which a mixture of warmer and colder parts of operating liquid takes place in a respective end bell 1 and the mixture of both flows through the passage 2 in the respective control disk 3 into the annular o space between the control disk 3 and the vane wheel 4 as shown by the curved arrow.

Air or other pumped media is sucked into the liquid ring machine through inlet 13. It passes through the end bell 1 and into the housing of vane wheel 4 by means of suction slot 5. Through action of the eccentrically mounted vane wheel and the rotating liquid ring, the pumped air is forced out via pressure slot 6 into end bell 1 from which it exits by outlet 12.

Since operating liquid can evaporate through action of the liquid ring and its intimate contact with the pumped medium, at least one inlet 14 is provided in known liquid-ring pumps for replenishment of operating liquid.

Figure 2:
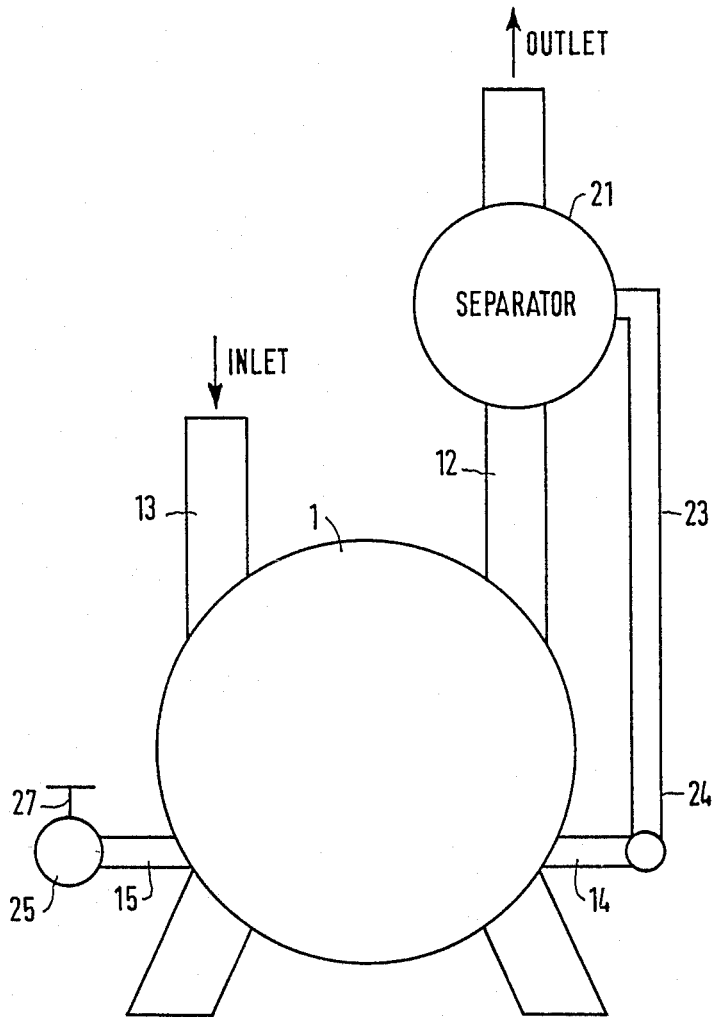
FIG 2 PRIOR ART
FIG. 2 is a schematic illustration of a prior art liquid-ring pump including a liquid separator.

Referring to FIG. 2, there is shown a prior art liquid separator 21 installed after the outlet passage 12. In the separator 21, warm operating liquid that has evaporated is recaptured and recycled by lines 23, 24 and a line 14 back to end bell 1. To further replenish the supply of operating liquid, cool liquid is provided from supply 27 via pump 25 under pressure through supply line 15 to end bell 1.

All the liquid entering the end bell 1 from the outside in the prior art pump of FIG. 1, i.e. by lines 14 or 15 be it warm or cold is mixed in the end bell. Yet, liquid in the suction operating area of the liquid ring is under reduced pressure and cold while liquid in pressure areas between the end bell 1 and the control disc 3 is warm. Supplying cold liquid to the liquid ring in the area of the pressure slot, according to prior art teachings, promotes greater undesirable operating liquid evaporation and greater need, for example, for a liquid separator 21 especially if a dry gas or air is the pumped media.

The present invention promotes a segregation of warm and cold portions of the operating liquid such that cold liquid is not supplied to the area of the pressure slot and, thus, the opportunity for liquid evaporation into the pumped medium is reduced.

Figure 4:
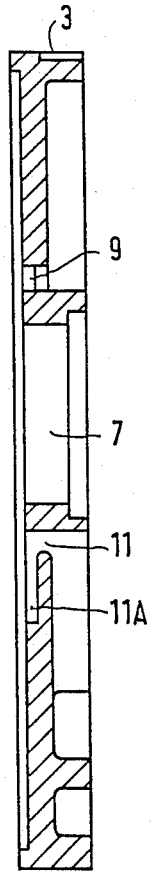
FIG. 4 is a side view of the present control disk in lateral cross-section along the axis III—III of FIG. 3.
Figure 3:
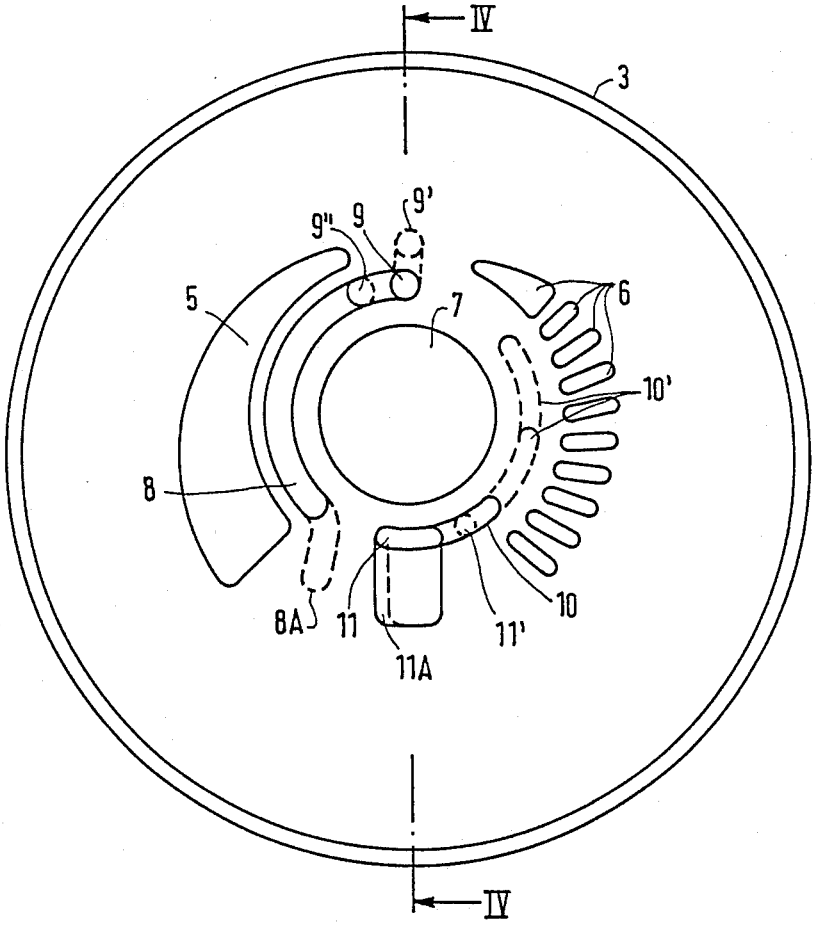
FIG. 3 is a top view showing particular detail of the present control disk design in longitudinal cross-section.
Figure 5:
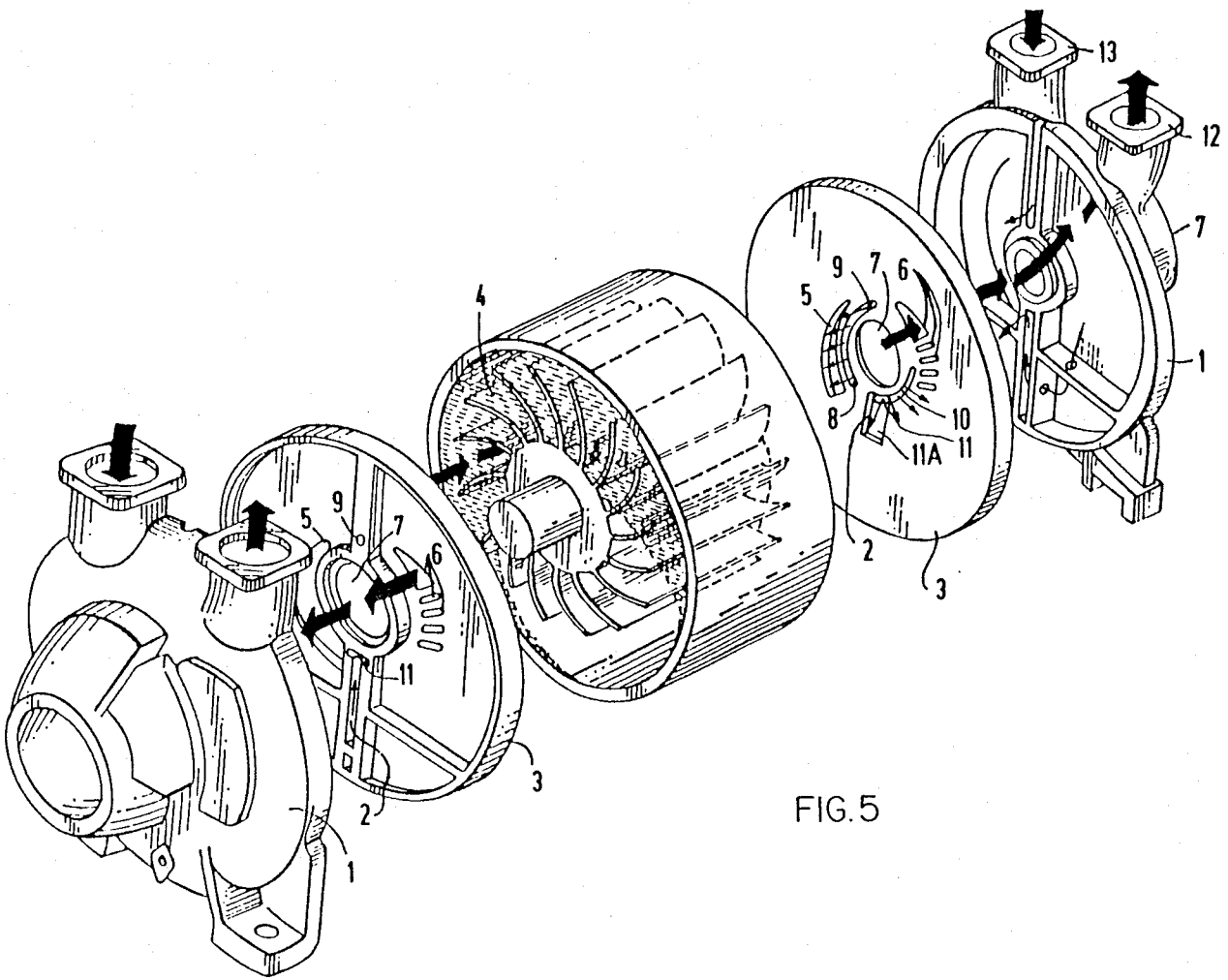
FIG. 5 is an exploded perspective view of a liquid-ring pump according to the invention.

To obtain the desired effect according to the present invention, the control disk is designed in accordance with an embodiment shown in FIG. 3 in a longitudinal cross-section or top view onto the inside facing the vane wheel. FIG. 4 is a side view of a lateral cross-section according to the line III—III of FIG. 3. Similar reference characters are employed in FIGS. 3 and 4 to denote the same elements.

In the region between a one-slit suction slot 5 and a shaft opening 7, a first partial ring slot 8 is provided which is connected to at least one opening 9, 9', or 9'' and this opening 9, 9', or 9'' opens into a separate chamber in the end bell, which chamber is connected exclusively to a cooling liquid inlet to which a fresh operating liquid line 15 is connected. Line 15 may also be coupled to a liquid separator 21 by way of a reflux cooler that cools warm portions of operating liquids to be recycled from the liquid separator.

The first partial ring slot 8 extends at least over the entire area of the suction slot 5 and can be brought out of the vicinity of the vane wheel pump shaft at one end 8A behind the end of the suction slot. In the alternative, the partial ring slot can be extended beyond the beginning or at a narrow end of the suction slot, bent out in the vicinity of the vane wheel pump shaft as shown by dashed lines, and connected there to an opening 9'. Advantageously, the opening or openings 9, 9', 9'' can be provided alternatively at the end 8A of the partial ring slot 8 (not shown) so that a cold portion of the gap liquid distributed as uniformly as possible flows over the entire suction slot 5 in the direction of the vane wheel rotation and outwardly, tending to optimize the condensation effect.

Between a one-slit or, as shown, a multi-slit pressure slot 6 comprising a plurality of radial slits and the shaft opening 7, a separate second partial ring slot 10, 10' is provided. The second partial ring slot 10, 10' extends in a counter-clockwise direction at least to the beginning of the pressure slot 6 and, at most, to the front of the end thereof and, in particular, up to the last radial slit 6 shown. Partial ring slot 10, 10' is connected at its beginning to at least one opening 11, or alternatively, opening 11' which opens into a separate chamber in the end bell where warm liquid from a liquid separator 21, without cooling, is returned via line 14 of FIG. 2, or where warm liquid is obtained from the rotating ring of liquid. Warmer liquid is thus fed as a gap-sealing liquid from this separate chamber of the end bell via the opening 11 to the second partial ring slot 10, 10' and from there flows into the liquid ring in a well known manner.

The opening 11 is covered by the vane wheel hub and can be in communication with a niche 11A which extends radially outward beyond the vane wheel hub.

What is claimed is:

1. A liquid-ring pump comprising:

(a) a housing, (b) a vane wheel having a hub and a shaft extending out on both sides of the hub, the vane wheel arranged eccentrically within the housing and adapted to revolve in engagement with a ring of rotating liquid, (c) end bells supporting the shaft of the vane wheel for rotation, the end bells being arranged on opposite sides of the housing, a first end bell having separate chambers for warm and cold portions of operating liquid, (d) said first end bell having a first inlet for feeding in cold liquid to the chamber of said first end bell for the cold portion of operating liquid and a second inlet for feeding in warm liquid to the chamber of said first end bell for the warm portion of operating liquid, and (e) a control disc sealingly disposed between the first end bell and the housing and provided with suction and pressure slots, first and second openings for the separate communication with the separate chambers for the warm and cold portions of operating liquid, a first slot covered by the vane wheel hub and disposed concentrically between the shaft and the suction slot, the first opening for communication with the chamber of the end bell for the cold portion of operating liquid opening into the first slot, and a second slot covered by the vane wheel hub and disposed concentrically between the shaft and the pressure slot, the second opening for communication with the chamber of the end bell for the warm portion of operating liquid opening into the second slot, the first and second slots being spatially separated from one another.

2. A liquid-ring pump according to claim 1 where the first and second slots comprise partial ring slots extending beyond an inner edge of the adjacent pressure and suction slots respectively.

3. A liquid-ring pump according to claim 2 wherein the first partial ring slot adjacent to the suction slot is formed with a bend at one end outward from the location of the vane wheel hub.

4. A liquid-ring pump according to claim 3 wherein the suction slot has a narrow end and a wide end, the first partial ring slot extending beyond the beginning of the suction slot at the narrow end thereof, being radially bent-off at the narrow end to protrude outward from the location of the vane wheel hub forming a bent-off portion, the opening for cold operating liquid located at the bent-off portion.

5. A liquid-ring pump according to claim 4, the second partial ring slot adjacent to the pressure slot extending beyond the inner edge of the pressure slot toward the wide end of the suction slot, the opening for feeding-in warm operating liquid being located at the end of the second partial ring slot adjacent the wide end of the suction slot, the feed-in opening having a communicating niche, protruding radially outward form the location of the vane wheel hub.

6. A liquid-ring pump according to claim 5, the pressure slot of the control disc being subdivided into plural radial slits, the second partial ring slot extending from the feed-in opening at most only to the end of the plural radial slits of the pressure slot.

7. A liquid-ring pump according to claim 1, wherein: said first inlet is connected to a source of cold liquid supply and said second inlet is arranged for feeding in warm liquid lost from the liquid ring.

* * * * *